United States Patent [19]

Caratsch

[11] 4,292,745

[45] Oct. 6, 1981

[54] AIR FOIL NOZZLE DRYER

[76] Inventor: Hans-Peter Caratsch, Itenhardstrasse 16, 5620 Bremgarten, Switzerland

[21] Appl. No.: 69,392

[22] Filed: Aug. 24, 1979

[30] Foreign Application Priority Data

Aug. 29, 1978 [CH] Switzerland ..... 9103/78

[51] Int. Cl.[3] ..... F26B 13/20

[52] U.S. Cl. ..... 34/156; 34/160; 34/222; 226/97

[58] Field of Search ..... 226/97, 196, 199; 34/155, 156, 160, 222, 229

[56] References Cited

U.S. PATENT DOCUMENTS

| | | | |
|---|---|---|---|
| Re. 24,871 | 9/1960 | Parkes | 34/156 |
| 2,038,457 | 4/1936 | Venturini | 34/155 |
| 3,008,243 | 11/1961 | Kawaguchi | 34/160 |
| 3,763,571 | 10/1973 | Vits | 34/156 |
| 4,069,595 | 1/1978 | Ahlbert et al. | 226/97 |

FOREIGN PATENT DOCUMENTS

| | | | |
|---|---|---|---|
| 1051231 | 2/1959 | Fed. Rep. of Germany | 34/160 |

*Primary Examiner*—Larry I. Schwartz

*Attorney, Agent, or Firm*—Werner W. Kleeman

[57] ABSTRACT

The air foil nozzle dryer for drying webs of material is provided with two nozzle arrangements opposite one another relative to the webs of material passing between. The distance between the nozzles of the two nozzle arrangements and the cross-sectional area of the nozzle orifices may be adjusted.

6 Claims, 4 Drawing Figures

AIR FOIL NOZZLE DRYER

BACKGROUND OF THE INVENTION

The present invention relates to an air foil nozzle dryer for drying webs of material, comprising two nozzle arrangements arranged opposite one another relative to the web of material passing between, said web of material being supported between these nozzle arrangements without contact.

In such air foil nozzle dryers the web of material is held in a hovering position and dried by the air streams emitted by the nozzles of the nozzle arrangements. The efficiency of an air foil nozzle dryer largely depends on the distance between the nozzles and the web of material. The closer the nozzles are located to the web of material, the more rapid is the breaking-up process of the boundary film required for the initiation of the drying process. However, it should be noted in determining the distance between the nozzles that, depending on the property of the web material and the distance between the latter and the nozzles, the hovering web of material may be undesirably aspirated to the nozzles (Bernoulli effect). This is indicated principally by a fluttering motion of the web of material, a phenomenon that occurs mainly along the edges.

In certain air foil nozzle dryers of the conventional type drawing-in apparatus are provided, which renders it necessary to make the distance between the nozzles large enough for the drawing-in apparatus to be moved between the nozzles. This in turn involves the disadvantage that the comparatively great distance between the nozzles and the web of material results in an extension of the drying time and/or in an increase in energy requirement for the reasons outlined above.

In addition, the drying process in the known air foil nozzle dryers can take place under optimal conditions only with webs of a material with specific properties. In the case of webs of material of which the properties of the material (areal weight, flexural stiffness etc.) deviate the said fluttering effect is observed to a greater or lesser degree. In order to avoid that, complex nozzle designs have so far been provided (see e.g. Swiss patent specification No. 542.080).

SUMMARY OF THE INVENTION

The present invention now has for its primary object to eliminate these disadvantages. Another significant object is the provision of an air foil nozzle dryer of the type initially described which enables webs of material of varying material properties to be optimally dried and perfectly hoveringly carried in a simple manner.

According to this invention the solution of this problem is characterized in that the distance between the nozzles of the two nozzle arrangements and possibly also the cross-sectional area of the nozzle orifices may be adjusted.

Thanks to the possibility of setting the optimal distance between the nozzles of the two nozzle arrangements for the web of material to be dried, webs of material of a variety of areal weights and flexural stiffnesses may be passed hoveringly between the nozzle arrangements with the minimum possible distance without producing a fluttering effect. In one and the same air foil nozzle dryer webs of material of a great variety of material properties may accordingly be dried, which, at the same rate of drying, results in an expenditure of energy which is lower than with the known air foil nozzle dryers. The air foil nozzle dryer according to this invention operates with greater efficiency than comparable dryers of the conventional design.

Alteration of the cross-sectional area of the nozzle orifices enables the air volume emerging from the nozzles to be altered which, in conjunction with the said distance adjustment of the nozzles, renders possible perfect adjustment to the properties of the web of material to be dried.

In a preferred embodiment according to claim 2 the various adjusting devices enable the cross-sectional areas of the nozzle orifices to be adjusted across their longitudinal direction, i.e. transversely to the direction of travel of the web of material.

BRIEF DESCRIPTION OF THE DRAWINGS

An embodiment of the invention will now be discussed in greater detail with reference to the drawing in which.

DETAILED DESCRIPTION OF THE INVENTION

Figure 1:
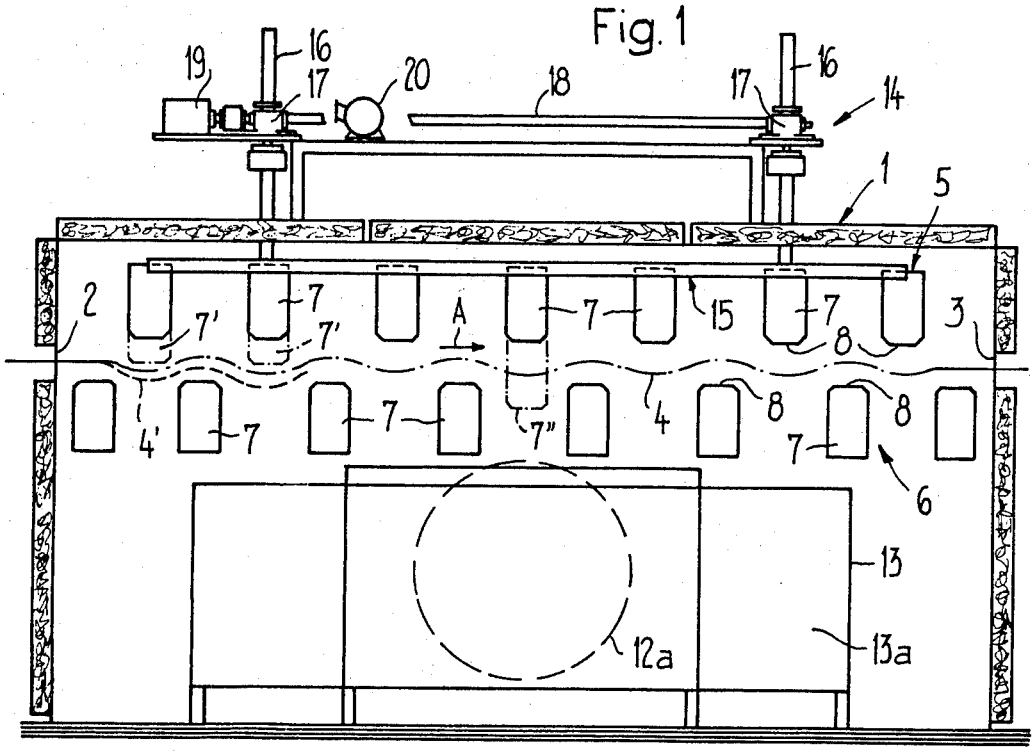
FIG. 1 is a diagrammatic longitudinal section through an air foil nozzle dryer.
Figure 2:
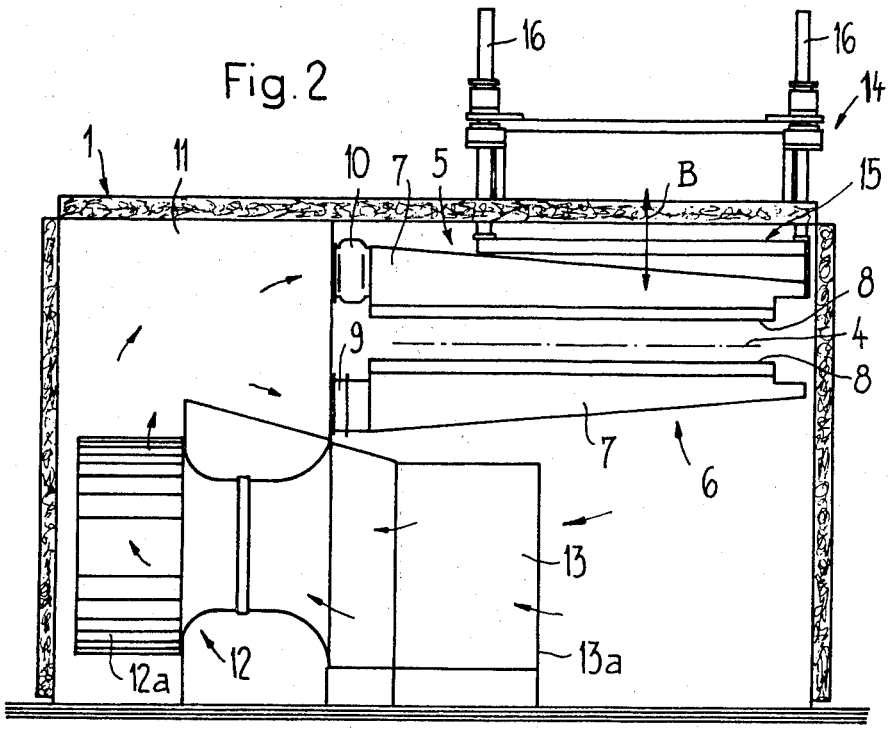
FIG. 2 is a diagrammatic cross-section of an air foil nozzle dryer.

In the air foil nozzle dryer shown in the Figures a housing 1 provided with an inlet opening 2 and outlet opening 3 for a web of material 4 accommodates an upper nozzle arrangement 5 and a lower nozzle arrangement 6. Each of these nozzle arrangements 5,6 consists of blowing chambers 7 which have their underside and top respectively provided with a discharge nozzle 8 of which the design is shown in greater detail in FIGS. 3 and 4. The blowing chambers 7 of each nozzle arrangement 5,6 extend transversely to the direction of travel A of the web of material 4 and are arranged at a mutual distance. The blowing chambers 7 of the upper nozzle arrangement 5 are staggered in the direction of travel A relative to the blowing chambers 7 of the lower nozzle arrangement 6 so that, as shown in FIG. 1, a blowing chamber 7 of one nozzle arrangement is located between two adjoining blowing chambers 7 of the other nozzle arrangement. The blowing chambers 7 of the lower stationary nozzle arrangement 6 are connected at their inlets, via a fixed connection 9, with the interior of an air distributing chamber 11. The blowing chambers 7 of the upper mobile nozzle arrangement 5 have their inlets connected, via a mobile connecting member 10, to the air distributing chamber 11. The air distributing chamber 11 is connected with the delivery side of a blower 12 of which the impeller is designated by the reference numeral 12*a*. Arranged on the suction side of the blower 12 is an air heater 13 with an inlet 13*a*.

For the purpose of raising and lowering the blowing chambers 7 of the upper nozzle arrangement 5 the said blowing chambers 7 are associated with an adjusting device generally designated at 14. This device is provided with a rectangular frame 15 to which the blowing chambers 7 of the nozzle arrangement 5 are attached. Connected with this frame 15 are four vertical guide rods 16 extending in the direction of adjustment B and provided with a toothing. The toothings of each guide rod 16 mesh with a worm 17. As shown in FIG. 1, the worms 17 for moving the guide rods 16 located on the same side relative to the direction of travel A of the web of material 4, are interconnected by a connecting rod 18 which connecting rod at one end is in driving engagement with a driving unit 19. The said driving unit 19 is driven by a motor 20 via a V-belt (not shown). The worms 17 serving to adjust the two guide rods 16 not visible in FIG. 1 are driven by the unit 19 in an analogous manner.

Figure 3:
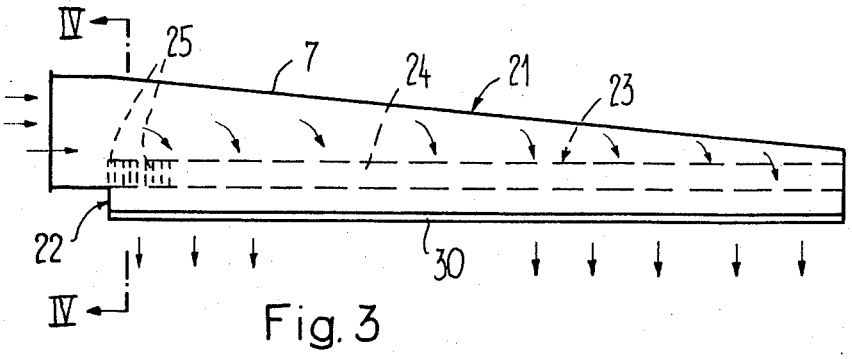
FIG. 3 is a diagrammatic side view of a blowing chamber.
Figure 4:
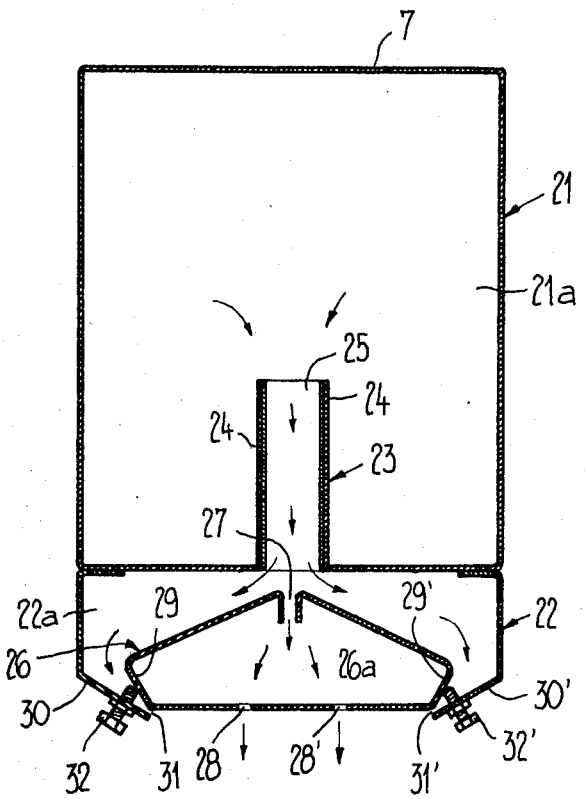
FIG. 4 is a diagrammatic cross-section along line IV—IV in FIG. 3.

FIGS. 3 and 4 show the design of the lower and upper blowing chambers 7 in greater detail. Each chamber 7 comprises a first chamber portion 21 of which the cross-section diminishes in the direction away from the connecting piece 9 and 10 respectively. Attached to the underside of the first chamber portion 21 is a second chamber portion 22 of which the interior 22*a* communicates with the interior 21*a* of the upper chamber portion 21 via a passage 23 extending in the longitudinal direction of the blowing chamber 7. This passage 23 is formed by two boundary walls 24 arranged in parallel relationship which extend in the longitudinal direction of the blowing chamber 7 and which project into the interior 21*a*. Partition walls 25 are arranged at intervals between the two boundary walls 24 which extend transversely to the said boundary walls 24. These partition walls 25 from individual passage ducts.

Arranged in the interior 22*a* of the lower chamber portion 22 is a hollow insertion member 26 which extends in the longitudinal direction of the blowing chamber 7. At its upper side facing the passage 23 the said insertion member 26 is provided with an inlet 27 which opens into the interior 26*a* of the insertion member 26. At its underside the insertion member 26 is provided with two rows of outlet orifices 28,28'. The side wall sections 29,29' of insertion member 26 form together with the guide walls 30,30' of the lower second chamber portion 22 two outlet slots 31,31' which extend in the longitudinal direction of the blowing chamber 7.

In order to enable the width of the outlet slots 31,31' to be adjusted, screws 32,32' are screwed into the guide walls 30,30', said screws 32,32' being distributed over the full length of the blowing chambers 7 and bearing against the insertion member 26. Adjustment of the screws 32,32' alters the distance between the guide walls 30, 30' and the insertion member 26 and thus the width of the outlet slots 31,31'.

Drying the web of material 4 is effected in the manner known with air foil nozzle dryers. The air drawn in by the blower 12 is heated in the air heater 13 and enters the first upper chamber portion 21 of the blowing chambers 7 and thence flows, via the passage 23, into the interior 22*a* of the second chamber portion 22 and continues, via the inlet 27, into the interior 26*a* of the insertion member 26. The partition walls 25 of the passage 23 deflect the air blown into the interior 21*a* of the chamber portion 21 through an angle of almost 90°. This deflection calms the passing air and ensures a uniform pressure distribution of the air passing into the interior 22*a* of the second chamber portion 22. The pressure in the outlet slots 31,31' is therefore free of fluctuations and thus even. A calming effect is furthermore exercised on the air in the interior 26*a* of the insertion member 26.

The air from the interior 26*a* is blown through the outlet orifices 28,28' vertically against the web of material 4 to be carried and thus forms an air cushion. The said air cushion is contained by the air emerging from the outlet slots 31,31' which forms a two-sided air curtain. This result is a relatively low rate of flow along the web of material 4 so that a fluttering effect is avoided. As the outlet slots 31,31' can be adjusted by altering the setting of the screws 32,32' the volume of air and, consequently, the supporting capacity can be adjusted to the weight of the web of material 4.

The width of the outlet slots 31,31' may be set differently along the length of the blowing chambers 7, i.e. in the direction transverse to the web of material 4, which makes it possible to vary the nozzle width over the width of the web of material.

As FIG. 1 shows, the web of material 4 is held hovering between the upper and the lower nozzle arrangement 5,6 by the air streams emerging from the blowing chambers 7. At the same time the web of material 4 is dried.

As previously outlined, the adjusting device 14 enables the blowing chambers 5 to be lowered or raised. The distance between the nozzles 8 of the two nozzle arrangements 5 and 6 can thus be adjusted. The upward and downward motion of the blowing chambers 7 of the upper nozzle arrangement 5 is effected by the driving motor 20 which causes the worms 17 to be turned via the unit 19 and the guide rods 16 to be raised and lowered. In this manner the distance between the outlet nozzles 8 of the blowing chambers 7 of the two nozzle arrangements 5,6 and thus the distance of the web of material 4 and the said outlet nozzles 8 may be adjusted optimally so that the said outlet nozzles 8 are as close to the web of material 4 as possible without pulling the web 4 against one of the blowing chambers 7. If the blowing chambers 7 of the upper nozzle arrangement 5 are in the position shown in full lines in FIG. 1, the web of material 4 passing between the two nozzle arrangements 5 and 6 in the direction of the arrow A will move along the path indicated by the dot-dash line. If the blowing chambers 7 of the upper nozzle arrangement 5 are lowered into the position shown by dot-dash lines and designated at 7', the distance between the blowing chambers 7 of the two nozzle arrangements 5,6 and the web of material 4 shown by a broken line and designated at 4' is reduced.

The blowing chambers 7 of the upper nozzle arrangement 5 may be lowered to such an extent that they mesh with adjacent blowing chambers 7 of the lower nozzle arrangement 6 as diagrammatically shown by the blowing chamber shown in a broken line and designated at 7''.

In deviation from the embodiment shown it is obviously possible to provide a stationary upper nozzle arrangement and a lower nozzle arrangement which can be raised and lowered. However, it is also possible to make both nozzle arrangements 5 and 6 capable of being raised and lowered.

It is furthermore possible, instead of adjusting all blowing chambers 7 collectively, to design the said blowing chambers so as to be raised and lowered individually, which would enable the distance between the blowing chambers 7 to be varied in the direction of travel A of the web of material 4.

The adjusting device 14 for raising and lowering one of the nozzle arrangements 5,6 or both of them may naturally be designed in a manner other than shown. Apart from further variants of a mechanical adjustment, pneumatically or hydraulically operating adjusting mechanisms may be contemplated.

Thanks to the possibility of adjusting the distance between the outlet nozzles 8 and the outlet slots 31,31' respectively and the web of material 4 by altering the relative position of the two nozzle arrangements 5 and 6 as well as of adjusting the width of the outlet slots 31,31' by means of the screws 32,32' to match the properties of the web of material, the air foil nozzle dryer according to this invention enables webs of material of a large variety of areal weights and differing flexural stiffness to be dried without the hazard of a fluttering effect of the web of material 4. As the drying process can be performed under optimal conditions for any web of material, a careful drying requiring comparatively little energy is possible.

The air foil nozzle dryer is suitable for drying textile, paper and plastic webs or webs of similar material.

What is claimed is:

1. An air foil dryer for drying webs of material moving through said dryer, comprising:

a drying chamber;

means arranged within said drying chamber for floatingly guiding said web of material during its movement;

said guiding means comprising two pluralities of nozzle means spaced apart opposite one another relative to said web of material;

each plurality of nozzle means comprising a plurality of nozzles which are provided with outlet orifices for a drying medium, said web of material being guided by the drying medium emanating from said nozzles without contacting said nozzles;

means for adjusting the space between the nozzles of the said two pluralities of nozzle means; and means for adjusting the cross-sectional area of said outlet orifices.

2. The web dryer according to claim 1, wherein said nozzles are provided with slots formed by two walls, the space between said walls being adjustable by means of individual adjusting devices distributed over the longitudinal direction of the nozzles.

3. The web dryer according to claim 2, wherein said adjusting devices comprise screws which rest against one of said walls and are screwed into the other of said walls.

4. The web dryer according to claim 1, wherein each plurality of nozzle means comprises a plurality of nozzles arranged at a mutual distance transverse to the direction of travel of the web of material, the nozzles of one plurality of nozzle means being staggered relative to the nozzles of the other plurality of nozzle means in the direction of motion of the web of material.

5. The web dryer according to claim 1, further including adjusting means connected with one of said plurality of nozzle means to adjust the position of the latter relative to the other plurality of nozzle means which is stationary.

6. The web dryer according to claim 1, further including means for individually adjusting the nozzles of at least one plurality of nozzle means relative to the nozzles of the other plurality of nozzle means.

* * * * *